United States Patent [19]

Michael

[11] Patent Number: 4,741,533

[45] Date of Patent: May 3, 1988

[54] GAMES APPARATUS

[75] Inventor: Robert Michael, Lane Cove, Australia

[73] Assignee: Keno Computer Systems Pty, Limited, Queensland, Australia

[21] Appl. No.: 930,208

[22] Filed: Nov. 14, 1986

[30] Foreign Application Priority Data

Nov. 15, 1985 [AU] Australia ..... PH3439

[51] Int. Cl.[4] ..... A63F 9/00

[52] U.S. Cl. ..... 273/144 B; 273/144 A

[58] Field of Search ..... 273/144

[56] References Cited

U.S. PATENT DOCUMENTS 4,583,736 4/1986 Lorraine ..... 273/144 A

FOREIGN PATENT DOCUMENTS 621848 2/1927 France ..... 273/144 A
795869 1/1936 France ..... 273/144 A
1197960 6/1959 France ..... 273/144 A
474750 10/1952 Italy ..... 273/144 A

*Primary Examiner*—Paul E. Shapiro
*Attorney, Agent, or Firm*—Jones, Tullar & Cooper

[57] ABSTRACT

A games apparatus for use in the game of "keno" includes an enclosure which is rotatable about two perpendicular axes. The enclosure consists of two spaced chambers lying along one of the axes with the chambers being connected by a passage which will allow objects contained within the chambers to pass between the chambers. Upon rotation of the enclosure about the two axes, the objects are arranged randomly so that a random sample of the objects may be selected from the enclosure.

7 Claims, 3 Drawing Sheets

15
14
10
11
15
30
33

GAMES APPARATUS

FIELD OF THE INVENTION

The present invention relates to games apparatus which randomly selects objects from a set of objects and more particularly but not exclusively to a games apparatus which may be employed in the game of "keno" or "lotto".

DESCRIPTION OF THE PRIOR ART

There are currently known machines which are employed in the game of "keno" and "lotto" which randomly select balls provided with numbers. These known apparatus have an enclosure which receives the balls, which enclosure is then rotated about a generally horizontal axis. However these known apparatus only approximate random selection since the enclosure is only rotated about a single axis.

SUMMARY OF THE INVENTION

It is the object of the present invention to overcome or substantially ameliorate the above disadvantage.

There is disclosed herein a games apparatus including an enclosure to receive a plurality of loose objects, means to rotate said enclosure about at least two perpendicular axes to randomly arrange the objects, and means to select one or more objects from within said enclsoure, to provide a set of selected objects with the selected objects being a random sample from the objects contained in the enclosure.

BRIEF DESCRIPTION OF THE DRAWINGS

A preferred form of the present invention will now be described by way of example with reference to the accompanying drawings in which.

DESCRIPTION OF THE PREFERRED EMBODIMENT

Figure 1:
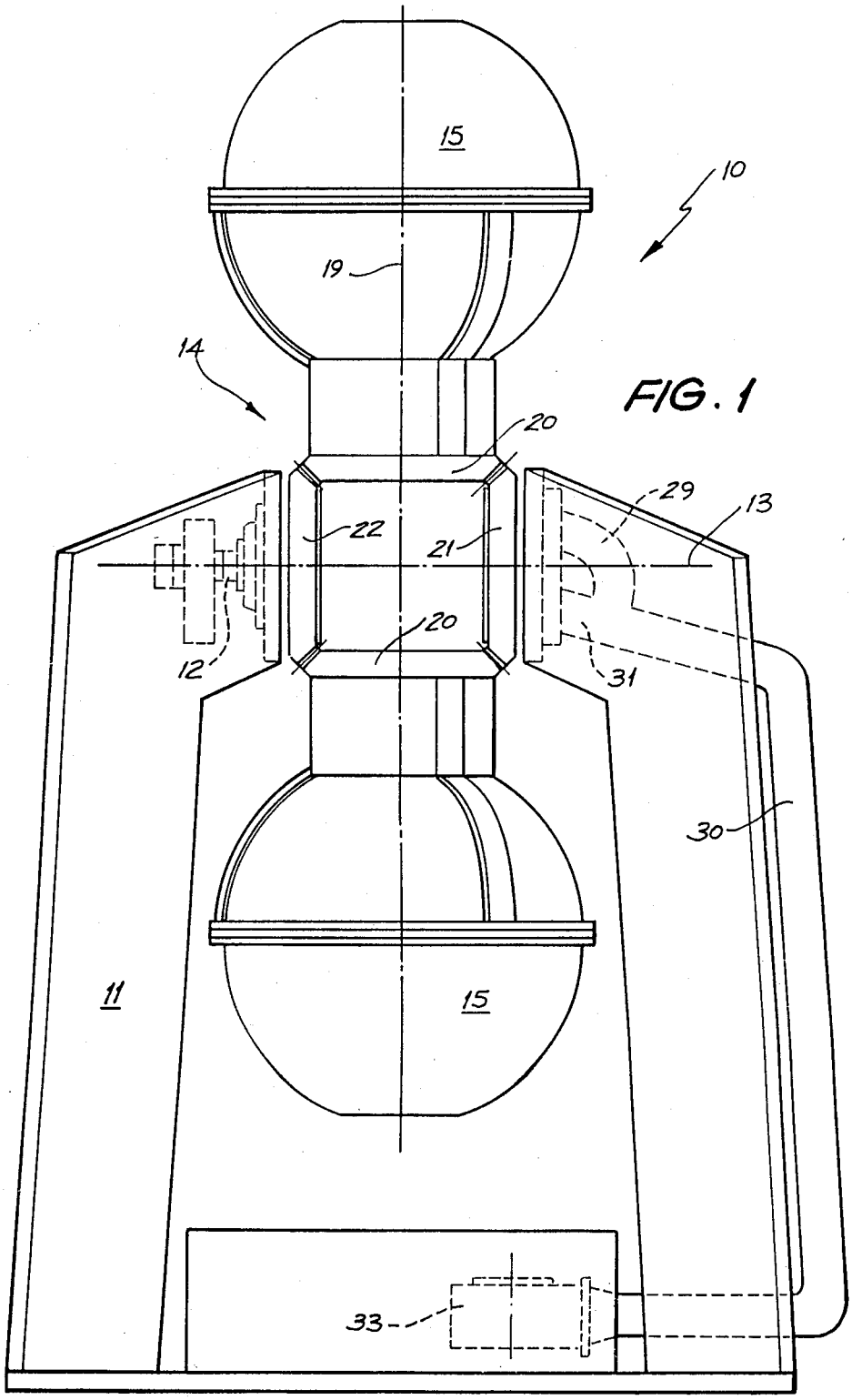
FIG. 1 is a schematic side elevation view of a games apparatus in accordance with the present invention.
Figure 2:
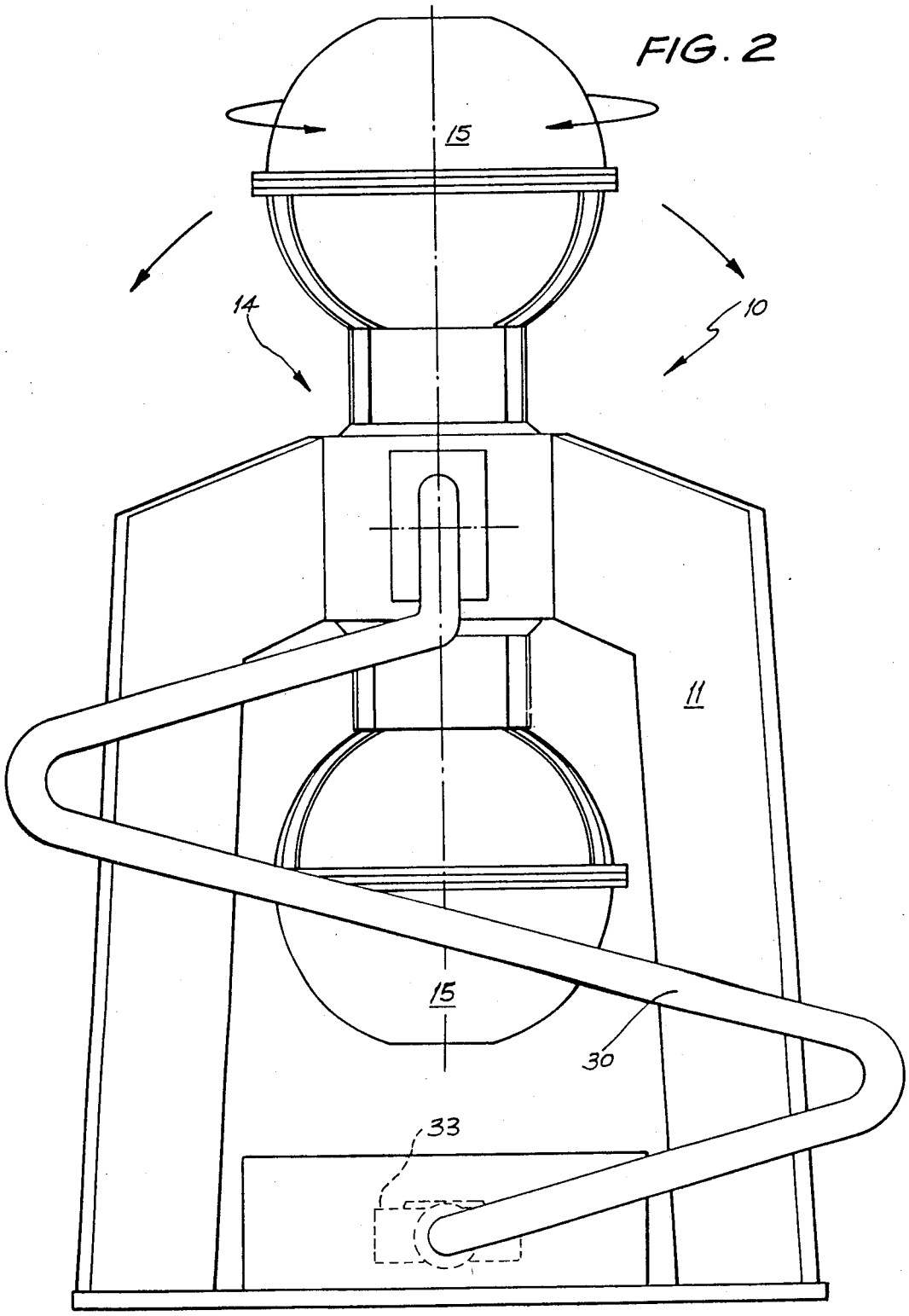
FIG. 2 is a schematic end elevation view of the apparatus of FIG. 1.
Figure 3:
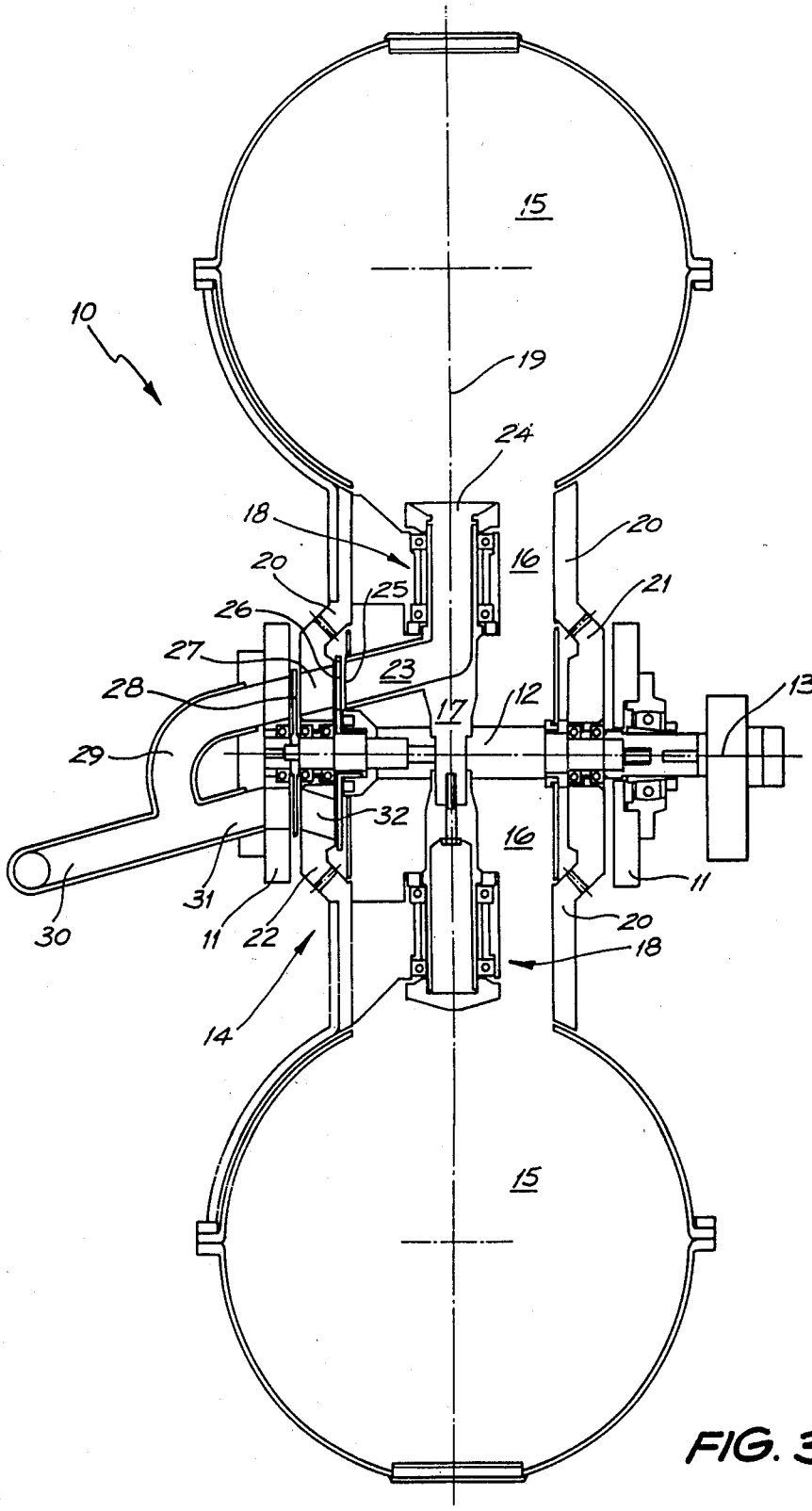
FIG. 3 is a schematic elevation view of the apparatus of FIG. 1.

In the accompanying drawings there are schematically depicted a games apparatus 10 having a frame 11 which rotatably supports a driven shaft 12. The shaft 12 can be driven by any suitable means. Mounted on the shaft 12 so as to be fixed thereto and rotated thereby about the axis 13 is an enclosure 14 consisting of two spherical chambers 15 joined by a duct 16 which extends around and longitudinally of the axis 19. In use, a plurality of numbered and/or coloured balls is delivered to the interior of the enclosure 14, with the balls dimensioned relative to the two chambers 15 and duct 16 so that the balls may pass between the two chambers 15. More particularly, the enclosure 14 is mounted on an axle 17 fixed to the shaft 12, with the individual chambers 15 mounted on an associated end of the axle 17 by means of bearing assemblies 18. Accordingly, the chambers 15 are rotatable about the axis 19 of the axle 17.

Fixed to each chamber 15 is a gear 20 with each gear 20 being coaxial with the axis 19. The gears 20 meshingly engage with a fixed gear 21 mounted on the frame 11. Accordingly upon rotation of the shaft 12, the chambers 15 are caused to rotate about the axis 13 while simultaneously being rotated about the axis 19 due to the meshing engagement of the gears 20 and 21. There is further provided an idler gear 22 freely rotatably mounted on the frame 11 to compensate for thrust forces generated by the meshing engagement of the gears 20 and 21. The idler gear 22 also meshingly engages with the gears 20.

Mounted on the axle 17 is a tube 23 having an open end 24 dimensioned to allow a ball or balls to enter the tube 23. The tube 23 has a delivery opening 25 selectively closed by means of a gate 26. Extending from the gate 26 is an extension tube 27 selectively closed by a gate 28. Extending from the gate 28 is a further tube 29 extending to a retaining tube 30 to retain a set of balls.

In operation of the abovediscussed apparatus 10, the balls are delivered to the interior of the enclosure 14 and the shaft 12 rotated in a predetermined direction. This in turn causes rotation of the chambers 15 about the axis 13 and the axis 19, while the axis 19 is in turn rotated about the axis 13. Thus the chambers 15 are rotated about three axes. When a ball is selected from the interior of the enclosure 14, the shaft 12 is held stationary with the opening 24 facing upwards. One or more balls will then enter the tube 23 with the leading ball being located in the tube 27. Upon further rotation of the shaft 12, in the same direction, the gate 26 blocks off the opening 25 and the gate 28 opens delivering the leading ball to the tube 30. The retaining tube 30 is inclined so that the balls are retained therein.

The gate 26 is a disc rotatably mounted on the shaft 12 so as to be rotatable relative thereto. The disc has a slot extending angularly about the axis 13, which slot is dimensioned to allow a ball to pass therethrough. Additionally the gate 26 is angularly movable between a first position closing the opening 25, and a second position wherein the slot is lined up with the opening 25 to allow delivery of a ball to the tube 27. Angular movement of the gate 26 between its two operative positions is achieved by a slipping magnetic clutch co-operating with two projections on the gate 26 which define the two operative positions thereof. More particularly, as the shaft 12 rotates in the abovementioned predetermined direction, the gate 26 is moved via magnetic attraction to a first operative position wherein it engages a first projection so that the gate 26 permits a ball to move therethrough. When the rotational direction of the shaft 12 is reversed, the gate 26 is moved to the other operative position closing the opening 25. The gate 28 is fixed to the shaft 12 so as to rotate therewith. The gate 28 is provided with a passage to allow a ball located in the tube 27 to pass therethrough. The passage in the gate 28 is angularly spaced from the passage 23 so that the opening 25 and the passage in the gate 28 are never aligned to allow a ball to pass simultaneously therethrough. Via co-operation of the gates 26 and 28 a single ball at a time is delivered to the tube 30. If so desired the tube 27 could be arranged, together with the gates 26 and 28, to deliver more than one ball.

Also extending from the tube 30 is a return tube 31 which is also selectively closed by the gate 28. The gate 28 allows a ball to pass from the tube 31 to the tube 32 when the axis 19 is vertical. Gate 26 also selectively closes the passage 32 relative to the duct 16. However, when the gate 26 is in its second operative position, as described above, a ball can pass from the tube 30 to the duct 16 via the tube 31.

The balls are moved from the tube 30 and through the tube 31 and into the duct 16 via a blower 33 which delivers air under pressure to the lower end of the tube 30 forcing the balls up the tube 30.

The abovediscussed preferred embodiment has the advantage of rotating the balls within the enclosure 14 about the axis 13 while simultaneously rotating the balls about the axis 19, while the axis 19 in itself is being rotated about the axis 13. Additionally the balls are randomly arranged by passing between the two chambers 15. This movement of the balls ensures random delivery of a ball or balls to the tube 23.

When the balls are being returned to the enclosure 14, the tube 32 is aligned with the tube 31.

What I claim is:

1. A games apparatus, said games apparatus comprising:

an enclosure to receive a plurality of loose objects;

means supporting said enclosure for rotation about at least two generally perpendicular axes so that said enclosure may be rotated to randomly arrange the objects;

drive means to drive said enclosure rotatably about one of said axes, said enclosure including two chambers spaced from each other in the direction of the other of said axes, said chambers being joined by a duct to permit the passage of the objects between said two chambers; and means to select one or more or the objects from within said enclosure to provide a set of selected objects with the selected objects being a random sample of the objects contained within said enclosure.

2. The games apparatus of claim 1 wherein said chambers are rotatably driven about said other axis by said drive means and are spaced on opposite sides of said one of said axes.

3. The games apparatus of claim 2 wherein said drive means includes a driven shaft coaxial with respect to said one of said axes, an axle extending from said shaft so as to define a rotational axis coaxial with said other axis, and wherein said chambers are rotatably supported on said axle.

4. The games apparatus of claim 3, further including a frame supporting said enclosure, and wherein said drive means for said enclosure includes a first gear fixed to said frame, a second gear fixed to at least one of said chambers and meshingly engaged with said first gear so as to be driven thereby, and wherein said first gear is coaxial with respect to said one of said axes, and said second gear is coaxial with respect to said other axis.

5. The games apparatus of claim 4, further including a third gear attached to the other one of said chambers and meshingly engaged with said first gear so as to drive said other chamber.

6. The games apparatus of claim 5, wherein said means to select one or more objects from within said closure includes a first passage communicating with one of said chambers, a first gate closing said passage so as to selectively permit an object to pass from said first passage, a second passage to receive the selected object from said first passage, and a second gate to selectively permit the selected object to pass from said second passage.

7. The games apparatus of claim 6, further including a return passage means to return selected objects to said enclosure.

* * * * *